US006046715A

United States Patent [19]

Towler et al.

[11] Patent Number: 6,046,715

[45] Date of Patent: Apr. 4, 2000

[54] LIQUID CRYSTAL ARRAY DEVICE

[75] Inventors: Michael John Towler, Oxford, United Kingdom; Akira Tagawa, Kashiwa, Japan

[73] Assignees: Sharp Kabushiki Kaisha, Osaka, Japan; The Secretary of State for Defence In Her Britannic Majesty's Government of the United Kingdom of Great Britain and Northern Ireland, Hants, United Kingdom

[21] Appl. No.: 08/854,116

[22] Filed: May 9, 1997

[30] Foreign Application Priority Data

May 17, 1996 [GB] United Kingdom ..... 9610321

[51] Int. Cl.[7] ..... G09G 3/36

[52] U.S. Cl. ..... 345/95; 345/101

[58] Field of Search ..... 345/94, 97, 101, 345/95

[56] References Cited

FOREIGN PATENT DOCUMENTS

| | | |
|---|---|---|
| 0642113 | 3/1995 | European Pat. Off. . |
| 0701241 | 3/1996 | European Pat. Off. . |
| 5731148 | 7/1982 | Japan . |
| 2173629 | 10/1986 | United Kingdom . |
| 2262831 | 6/1994 | United Kingdom . |
| 9524715 | 9/1995 | WIPO . |

OTHER PUBLICATIONS

Search Report for Application No. GB 9610321.3; dated Aug. 12, 1996.

P.W.H. Surguy et al, Ferroelectrics, 1991, vol. 122, "The 'Joers/Alvey' Ferroelectric Multiplexing Scheme", pp. 63–79.

J.R. Hughes et al, Liquid Crystals, 1993, vol. 13, No. 4, "A New Set of High Speed Matrix Addressing Schemes for Ferroelectric Liquid Crystal Displays", pp. 597–601.

*Primary Examiner*—Matthew Luu

[57] ABSTRACT

A liquid crystal array device comprises a liquid crystal material contained between two substrates, a first and a second plurality of electrodes defining a plurality of pixels and driving circuitry for applying a first signal (Strobe Voltage) in succession to the first plurality of electrodes and for applying a plurality of second signals (Data Voltage) to each of the second plurality of electrodes. Each second signal comprises one of at least a first waveform and a second waveform and the first waveform and the second waveform each comprise first and second signal levels. The first waveform and the second waveform further comprise at least one portion at a third signal level different from the first and second signal levels. This provides a limited difference in heating effect upon the array between a signal comprising a plurality of first waveforms and an alternating succession of first and second waveforms.

20 Claims, 4 Drawing Sheets

LIQUID CRYSTAL ARRAY DEVICE

FIELD OF THE INVENTION

The present invention relates to a liquid crystal array device having improved resistance to pixel-pattern dependent temperature effects. The invention has particular, but not exclusive, application to a large area liquid crystal array device in which the liquid crystal material is a ferroelectric liquid crystal material. The invention also relates to a driving arrangement for a liquid crystal array device and to a method of driving a liquid crystal array device.

BACKGROUND OF THE INVENTION

Addressing techniques or multiplexing schemes for liquid crystal array devices are known. Typically, the array will comprise a first plurality of electrodes arranged parallel to each other on a first substrate of the device and the second plurality of electrodes arranged parallel to each other, but perpendicular to the first plurality of electrodes, on the second substrate of the device. A plurality of liquid crystal pixels are thus defined at the point where these perpendicular electrode structures intersect. Because each liquid crystal pixel does not have its own unique electrode connections some form of multiplexing is required to address the pixels of the device. Usually a first signal, known as a strobe signal, is applied in succession to each of the first plurality of electrodes while a second signal is applied to each of the second plurality of electrodes. Thus, when the strobe signal is applied to a given electrode (hereafter referred to a row electrode) data signals may be applied to the second plurality of electrodes (hereafter referred to as column electrodes) to control the state of the pixels in that row.

One such multiplexing scheme, applied to ferroelectric liquid crystal displays, is described in the "JOERS/ALVEY Ferroelectric Multiplexing Scheme published in Ferroelectrics 1991, Volume 122, pages 63 to 79. In the scheme described in this prior art reference the plurality of second signals comprise either a first or second data waveform. The first data waveform comprises a positive-going rectangular wave immediately followed by a negative-going rectangular wave of the same amplitude and duration. The second data waveform is the inverse of the first.

In a liquid crystal device array which is addressed using such a multiplexing scheme the column (data) waveforms are applied to all of the pixels in their respective columns regardless of whether those pixels are actually being addressed. In other words the column waveforms are applied to the pixels of the device which are not receiving a strobe signal at that moment. When the array device is a ferroelectric liquid crystal (FLC) array the application of these waveforms is required to provide AC stabilization of the liquid crystal material in the device. As its name suggests, AC stabilization comprises an alternating signal applied to pixels which do not currently have a strobe signal applied to them. The stabilization is applied to provide improved brightness and contrast in a display device as is well known in the art.

These waveforms cannot be removed by, for example, arranging for the row driving circuitry to be open-circuit when a strobe signal is not applied to a particular row. The voltage of the floating row electrode would effectively be at a level specified by an average of the voltage applied to the columns. For example, if all of the column electrodes have a voltage V applied then the row electrode will also be at a voltage V resulting in zero potential across the liquid crystal in that row and no AC stabilization. However, if some of the column electrodes have a voltage V applied and some have a voltage −V applied then the row voltage would be at an intermediate level and some AC stabilization would be effected. As the contrast ratio and brightness are a function of the AC stabilization voltage this technique could reduce the total power consumed by the panel but would generally lead to a spatial and temporal variation in image quality.

Such liquid crystal device arrays, particularly large area liquid crystal arrays, provide not inconsiderable driving problems because they comprise a large number of capacitors (the pixels) connected by a series string of resistors (the electrodes). The AC waveforms applied to the column electrodes thus have to drive a distributed RC ladder at high frequency. This causes power dissipation in the resistances and the liquid crystal array device warms up. This causes a particular problem in ferroelectric liquid crystal array devices which are much more sensitive to temperature than, say, an equivalent nematic liquid crystal device.

SUMMARY OF THE INVENTION

It is an object of the present invention to provide a liquid crystal array device which is less susceptible to temperature variations.

It is another object of the invention to provide a driving arrangement for a liquid crystal array device for reducing this temperature variation.

It is a still further object of the present invention to provide a driving method for a liquid crystal array device which method reduces the effects of this temperature variation.

According to a first aspect of the present invention there is provided a liquid crystal array device comprising a liquid crystal material contained between two substrates, a first and a second plurality of electrodes defining a plurality of pixels and driving circuitry for applying a first signal in succession to the first plurality of electrodes and for applying a plurality of second signals to each of the second plurality of electrodes, each second signal comprising one of at least a first waveform and a second waveform, the first waveform and the second waveform each comprising first and second signal levels, wherein the first waveform and the second waveform further comprise at least one portion at a third signal level different from the first and second signal levels to provide a limited difference in heating effect upon the array between a signal comprising a plurality of first waveforms and an alternating succession of first and second waveforms.

According to a second aspect of the present invention there is provided a driving arrangement for a liquid crystal array device, which device comprises a liquid crystal material contained between two substrates and a first and a second plurality of electrodes defining a plurality of pixels, the driving arrangement comprising: means for applying a first signal in succession to the first plurality of electrodes and means for applying a plurality of second signals to each of the second plurality of electrodes which second signals each comprise one of at least a first and a second waveform, the first and second waveforms each comprising first and second signal levels, wherein each of the first and second waveforms further comprise at least one portion at a third signal level different from the first and second signal levels for providing a limited difference in heating effect when a signal comprising a plurality of first waveforms is applied to the liquid crystal array device and when a signal comprising alternating first and second waveforms is applied to the device.

According to a third aspect of the present invention there is provided a method of driving a liquid crystal array device, which device comprises a liquid crystal material contained between two substrates and a first and a second plurality of electrodes defining a plurality of cells, the method comprising applying a first signal in succession to the first plurality of electrodes and applying a plurality of second signals to each of the second plurality of electrodes which second signals each comprise one of at least a first and a second waveform, the first and second waveforms each comprising first and second signal levels, wherein each of the first and second waveforms further comprise at least one at the third signal level different from the first and second levels for providing a limited difference in heating effect upon the array when a signal comprising a plurality of first waveforms is applied to the array and when a signal comprising alternating first and second waveforms is applied to the array.

The present invention concerns a hitherto unrecognized problem in the field of liquid crystal array devices and that is of temperature variations over the device caused by differences in the patterns being displayed. This pattern-dependent heating is a consequence of the different waveforms applied to the column electrodes of an array device because of the state of the liquid crystal display pixels in that column. For the sake of simplicity we confine ourselves to describing pixels occupying either a white or a black state. However, the invention is also applicable to multi-color displays and displays whose pixels are capable of displaying more than two optical states (for example so called "grey scale"). If it is imagined that a column of a liquid crystal device comprises pixels which are all in the black state then the column driving waveform corresponding to black will be repeatedly applied to all of the pixels in that column. Conversely, if it is imagined that the pixels in a particular column occupy the states black, white, black, white etc. then the data waveforms relating to these two states are applied consecutively to all of the pixels in that column. Using prior art data waveforms, such as those described in the foregoing document, these two pixel patterns result in extremes of power generation levels. The heating effect of these two combinations of waveforms is rather different. Significant temperature variations can arise across a liquid crystal array device displaying these two pixel patterns. Particularly for the case of a ferroelectric liquid crystal device this can cause problems of contrast between different parts of a display and even switching failures.

The present invention is based on the realisation that if the two waveforms described above are arranged to provide similar heating effects, the pixel pattern dependent heating problem is significantly reduced. It has been appreciated that addition of a third signal level to the known two-level column data waveforms then the pixel pattern-dependent heating effect is significantly reduced. The third signal level will typically be somewhere between the other two signal levels of the data waveform. Where the first two signal levels of the data waveforms are of equal magnitude but of opposite sign the third signal level is preferably zero volt.

The duration of the portion of the signal at the third signal level is important. Generally, as the length of this portion increases, the pattern-dependent heating effects are reduced. However, the portion at the third signal level preferably should not exceed one quarter of the duration of the data waveform because a longer portion would reduce the switching reliability of the device and/or the speed at which it could be addressed.

The first and second data waveforms in accordance with the invention may also comprise a further portion at the third signal level. This may be used to provide a signal which is balanced in time to still further reduce the difference in heating effects between the combinations of data signals which result in extremes of power generation.

For a fuller understanding of the nature and advantages of the invention, reference should be made to the ensuing detailed description taken in conjunction with the accompanying drawings.

DESCRIPTION OF THE EMBODIMENTS

Figure 1:
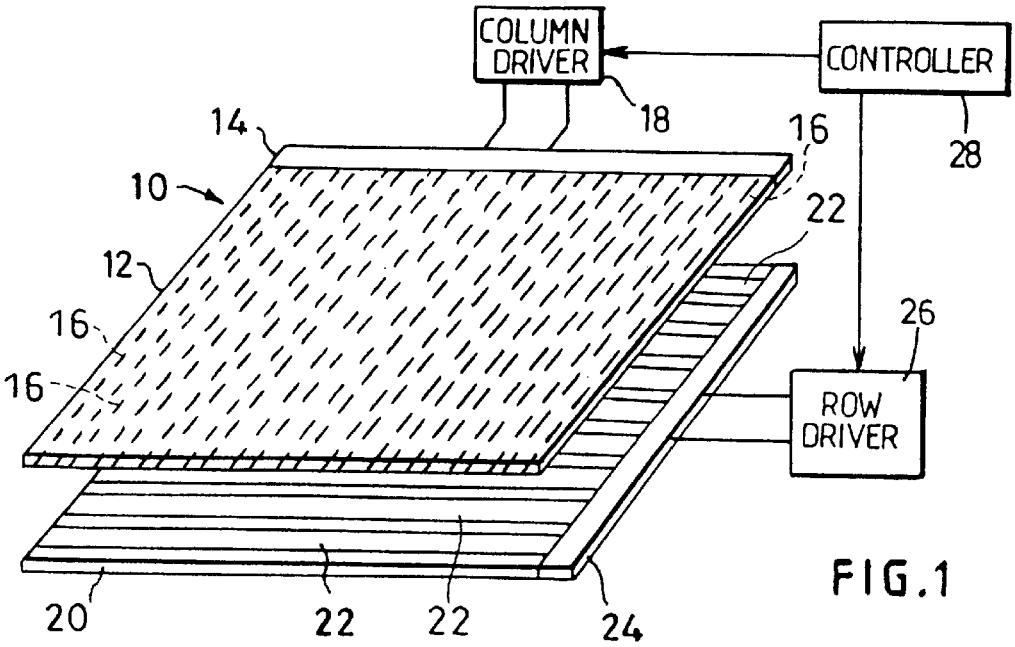
FIG. 1 shows a block schematic diagram of a liquid crystal array device in accordance with the present invention.

FIG. 1 shows a ferroelectric liquid crystal array device 10 comprising a first transparent substrate 12 and a second transparent substrate 20 spaced apart from the first substrate by known means such as spacer beads (not shown). The substrate 12 carries a plurality of electrodes 16 (shown in broken lines) of transparent tin oxide on that surface of the substrate that faces the second substrate 20. The electrodes 16 are arranged parallel to one another and each extend between a first edge of the substrate 12 and a second edge at which an electrical connector 14 is arranged to connect each electrode to a column driver 18. The substrate 20 carries a plurality of transparent electrodes 22 also arranged in parallel with one another but at right angles to the electrodes 16 on the first substrate. The electrodes 22 extend from a first edge of the substrate 20 to a second edge at which an electrical connector 24 links them to a row driver 26. Both the row driver 26 and the column driver 18 are connected to a controller 28 which will typically comprise a programmed microprocessor or an application specific integrated circuit (ASIC). Other electrode configurations can be applied to the liquid crystal device to provide, for example, a seven segment display, an r, θ display and so on. The liquid crystal device will also comprise polarizing means and alignment layers (not shown) as is known to those skilled in the art. Alternate electrodes on each substrate of the device may be connected to the row and column drivers at opposite edges of the substrates. The operation of the device will be described in greater detail below.

Figure 2:
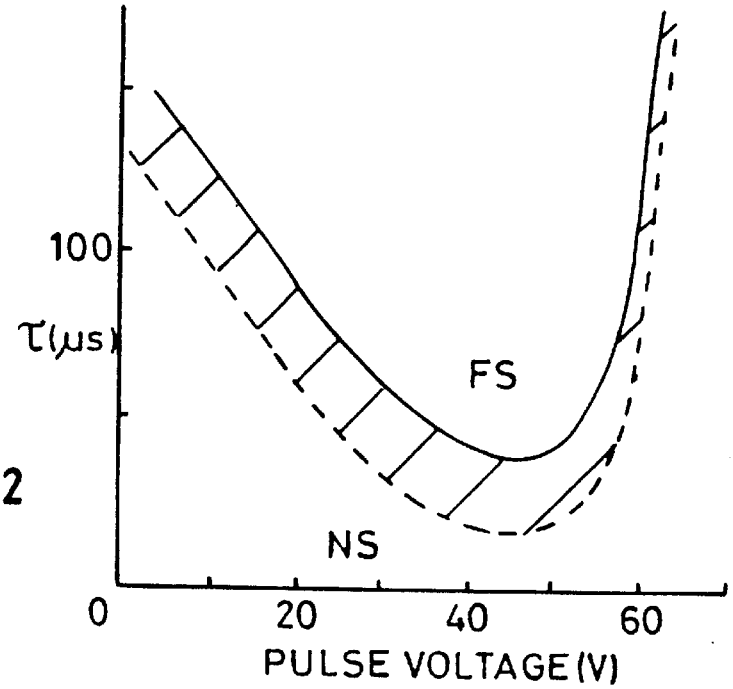
FIG. 2 shows a typical τV switching characteristic for a ferroelectric liquid crystal display device.

FIG. 2 shows a typical example of a τV switching characteristic for a ferroelectric liquid crystal device. Some ferroelectric liquid crystal materials have a minimum in their τV curves, which is useful for some driving schemes including the JOERS/Alvey driving scheme mentioned above. In FIG. 2 the region FS of the graph corresponds to a voltage-time product that will ensure that the pixels of the device will switch fully to the other state. The region NS of the graph corresponds to voltage-time products that will not cause the pixel to switch at all. A small band between these two regions denotes the partial switching region which corresponds to voltage-time products that will cause some, but not all of the area of a pixel to switch to the other state. τV characteristics of ferroelectric liquid crystal materials with a minimum in the curves are generally affected by a pre-pulse applied before the main switching pulse. Therefore, the combination of the strobe waveform and the non-switching data waveform, and the combination of the strobe waveform and the switching data waveform usually have their own τV curves. The former must result in a τV product that falls in the region NS in its curve, and the latter must result in a τV product that falls within the region FS in its curve. In addition, either of the data waveforms on their own must result in a τV product that falls in the region NS. To compound the difficulties, the ferroelectric LCD is particularly sensitive to temperature and as the device heats up, the position of the τV switching curve moves.

Figure 3:
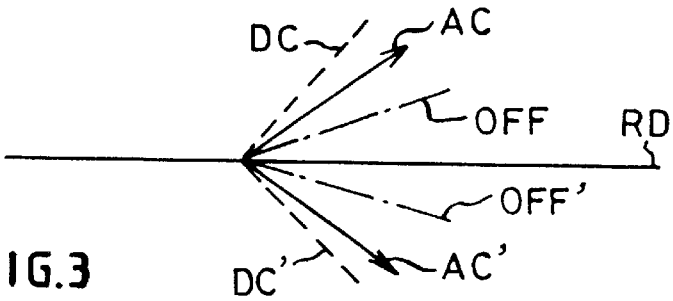
FIG. 3 shows the effect of AC stabilisation on the director of a ferroelectric liquid crystal molecule in an array device.

The optical behavior of ferroelectric liquid crystal materials is due to the orientation of the molecules (or their directors). FIG. 3 shows positions of the directors of ferroelectric molecules under various driving conditions. The line RD corresponds to a rubbing direction applied to the faces of the substrate in order to orient the liquid crystal molecules during manufacture. FIG. 3 shows a plan view of molecules as observed normal (perpendicular) to the liquid crystal device which corresponds to the conventional viewing angle. When a DC voltage of a first polarity is applied to the device the molecule will occupy the position DC shown by a dotted line provided that the magnitude of the voltage is high enough. The same applies for a DC voltage of the inverted polarity and the opposite position DC'. When the display has no voltage applied the directors relax to one or other of the positions OFF or OFF' depending upon whether they were previously on the same side of the line RD. The two director positions AC and AC' are the so called AC stabilized positions which the directors occupy as a result of the data waveforms applied continuously to the columns of the display (i.e. even when no strobe signal is applied). These AC stabilized positions are important because they permit the angle through which the directors are switched to be altered which allows good contrast to be maintained for the display.

Figure 4:
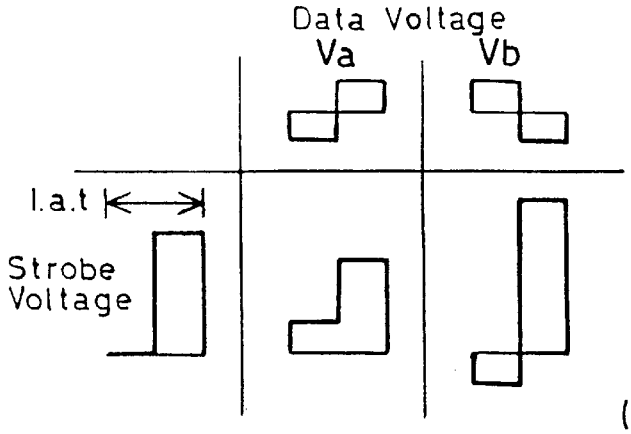
FIG.4 (PRIOR ART)
FIG. 4 shows an example of conventional electrode driving waveforms for a ferroelectric liquid crystal array device, FIGS. 5(*a*) and 5(*b*) show two voltage waveforms applied to the column electrodes of a liquid crystal array device as a consequence of using the driving waveforms shown in FIG. 4.

FIG. 4 shows one of the examples of the conventional driving schemes, which is the so called J/A (JOERS/ALVEY) driving scheme. In this figure, data voltage Va gives switching and data voltage Vb gives non-switching to pixels which are on the scanning (or row) electrode selected by strobe voltage. Therefore it can be easily understood that the angular frequency of the applied voltage to pixels depends on the pixel pattern or the information displayed on the column to which the pixel belongs. For example, if the black and white states are displayed on alternate pixels line by line (row by row) on one column, the applied voltage to the pixels on this column is like that shown in FIG. 5(*a*). If only the black state is displayed on the pixels of one column, the applied voltage to the pixels on this column is like that shown in FIG. 5(*b*). The fundamental angular frequencies ω of the applied voltages in FIGS. 5(*a*) and 5(*b*) are π/l.a.t. and 2π/l.a.t. respectively, where l.a.t. refers to the line address time is the time for which each line (or row) has a strobe signal applied. This means that the angular frequency of the voltage applied to the pixels depends on the pixel pattern. Consequently the power dissipation over the array also depends on the pixel pattern. This fact gives temperature variation over the panel area by the pixel pattern, The τV switching behavior thus varies over the array which reduces the driving margin. This means that the variation in voltage which may be applied between different pixels is reduced and the brightness and contrast of the display can deteriorate.

Figure 5:
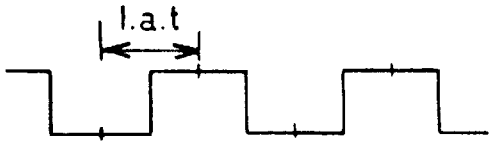
FIG.5 (a) (PRIOR ART)
Figure 5:
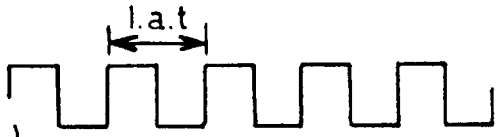
FIG.5 (b) (PRIOR ART)

From FIGS. 4, 5(*a*) and 5(*b*), it can be easily understood that the fundamental angular frequency ω of the voltage applied to the pixels changes from π/l.a.t. to 2π/l.a.t. by the pixel pattern. The applied voltage waveforms which give the lowest and highest power dissipation, are FIGS. 5(*a*) and 5(*b*) respectively.

Figure 6:
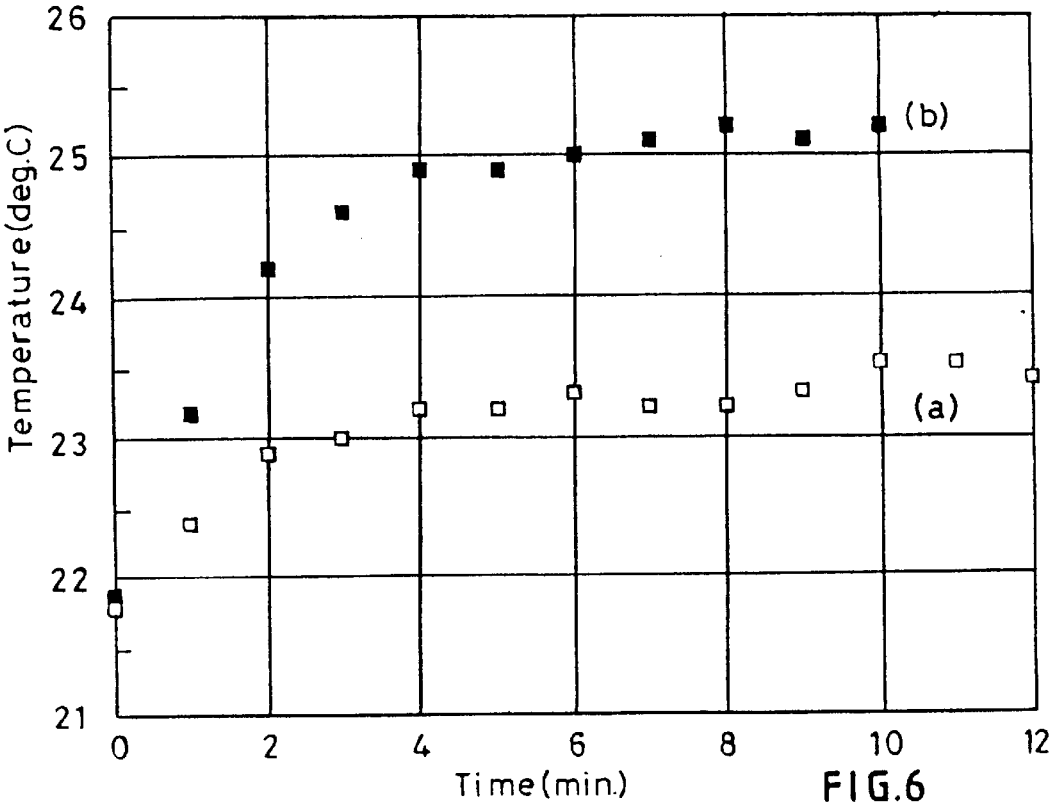
FIG.6 (PRIOR ART)
FIG. 6 shows the temperature dependence of a ferroelectric liquid crystal device when driven by the prior art driving waveforms.

FIG. 6 shows experimental results using small FLC test cell with 1×1 $cm^2$ electrode area. The figure shows temperature change of the surface of the FLC Cell-A applying square waveforms corresponding to FIGS. 5(*a*) and 5(*b*). The curve corresponding to the waveform in FIG. 5(*a*) is shown by white squares and that corresponding to FIG. 5(*b*) is shown by black squares. The l.a.t. was 10 μs, the amplitude of the applied voltage was 10 V. The spacing of this cell was about 1.8 μm and contains ferroelectric liquid crystal material SCE 8 (Merck Ltd., Merck House, Poole, U.K.—now available from Hoechst Aktiengesellscaft, Frankfurt am Main, Germany). It can be easily seen that the pixel pattern affects the temperature of the surface of the cell. Even in this small test cell temperature variation caused by the difference in pixel pattern is more than 1.5 degrees.

Although other driving schemes have been suggested, almost all of these have data voltages which are DC balanced within a line address time (to prevent dielectric breakdown of the ferroelectric liquid crystal cell). Therefore, pixel pattern dependence of the dissipated power is an essential problem for FLCDs, especially large area, small cell spacing FLCDs.

Figure 7:
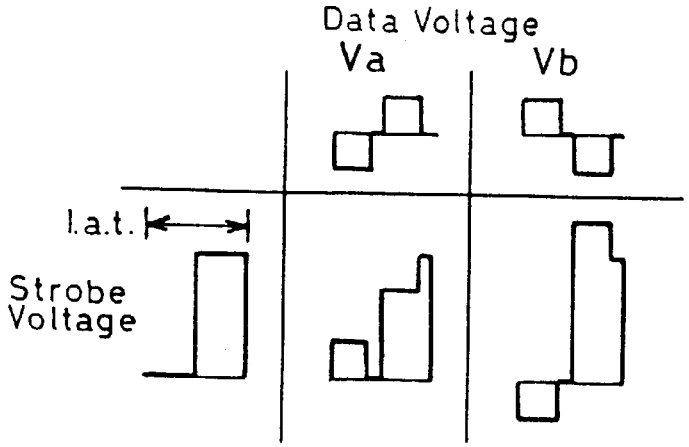
FIG. 7 shows the data, strobe and resultant waveforms of one multiplex addressing scheme in accordance with the invention, FIGS. 8(*a*) and 8(*b*) show the two waveforms having extreme heating effects which are applied to the columns of a device in accordance with the invention.

FIG. 7 shows one of the examples of driving schemes which solve the above mentioned problem. This corresponds to the conventional J/A driving scheme, but each of data voltages has periods with a voltage of zero when the polarity change occurs. The term 'polarity change' means polarity changes from plus to minus, from minus to plus, from plus to zero, from zero to plus, from minus to zero, or from zero to minus. In data waveforms the ratio of periods of the pulse and the gap with voltage of zero is 3:1. In this driving scheme, the power dissipated by the array depends to a smaller extent on the pixel pattern. The generation of the data voltages is discussed in greater detail with reference to FIG. 11 below.

Figure 8:
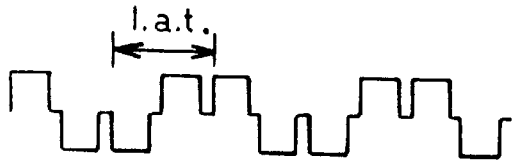
Figure 8:
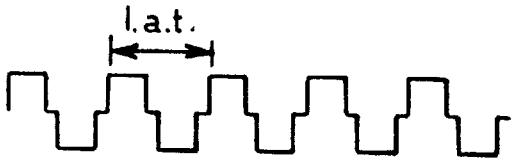

FIGS. 8(*a*) and 8(*b*) show examples of applied voltages to pixels during driving, using the driving scheme shown in FIG. 7. FIGS. 8(*a*) and 8(*b*) show the cases which give the lowest and highest frequency of the applied voltage respectively which correspond with the waveforms shown in FIGS. 5(*a*) and 5(*b*) for the conventional J/A driving scheme.

Figure 9:
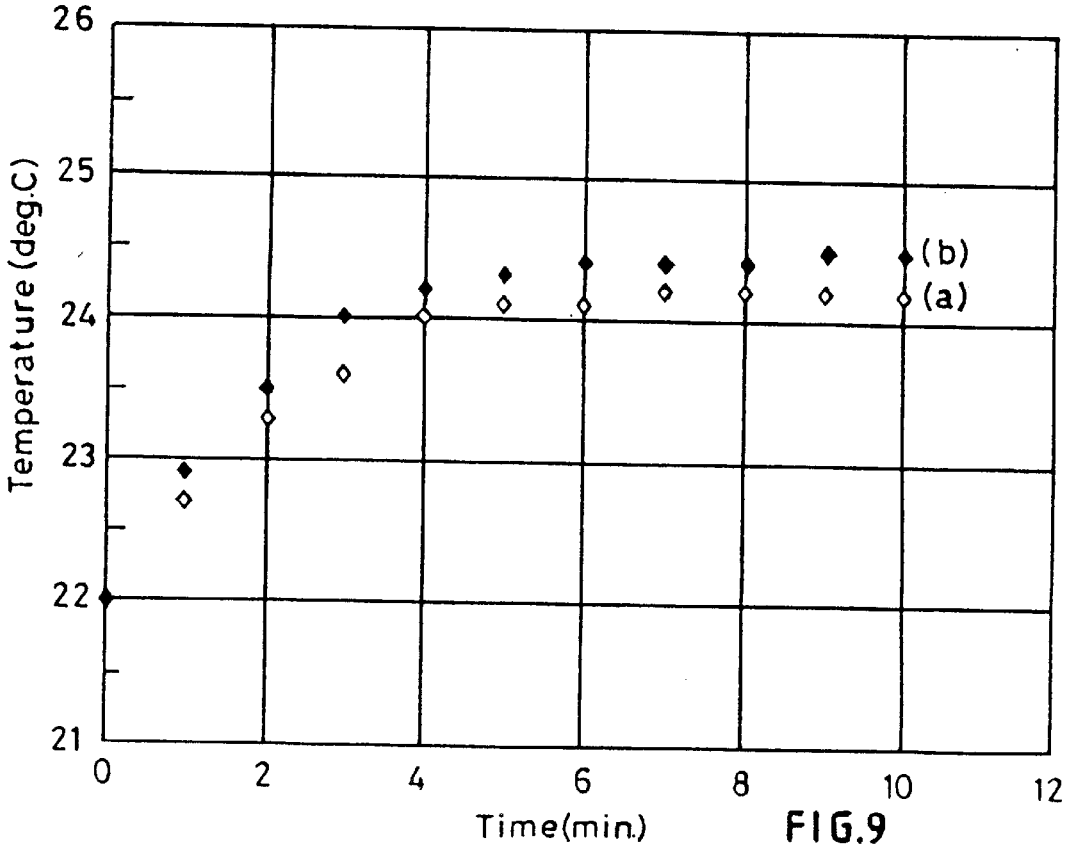
FIG. 9 shows the temperature dependence of a ferroelectric liquid crystal device when driven in accordance with the invention.

FIG. 9 shows temperature increase of the above mentioned small test cell applying the waveforms shown in FIGS. 8(*a*) and 8(*b*). FIG. 9 corresponds to FIG. 6 for the conventional J/A driving scheme and uses the same symbols. Temperature variation by the pixel pattern is only about 0.2 degree centigrade, which is much smaller than that of the conventional J/A driving scheme at approximately 1.5 degree centigrade.

This invention helps to enable large area, video rate FLCDs. Using the driving waveform set in which each of data voltages has periods with voltage to be reduced to zero when the polarity changes from plus to minus, or from minus to plus ('plus' and 'minus' include zero), the power dissipation variation over the panel can be much reduced. Consequently non-uniformity of temperature over the panel will be reduced so that the multiplexing operating region of the whole panel will be increased. In other words the driving margin will deteriorate less due to pixel pattern-dependent heating effects. The operating region refers to a range of driving conditions specified between switching and non-switching curves and it will be explained in greater detail below with reference to FIG. 10.

Figure 10:
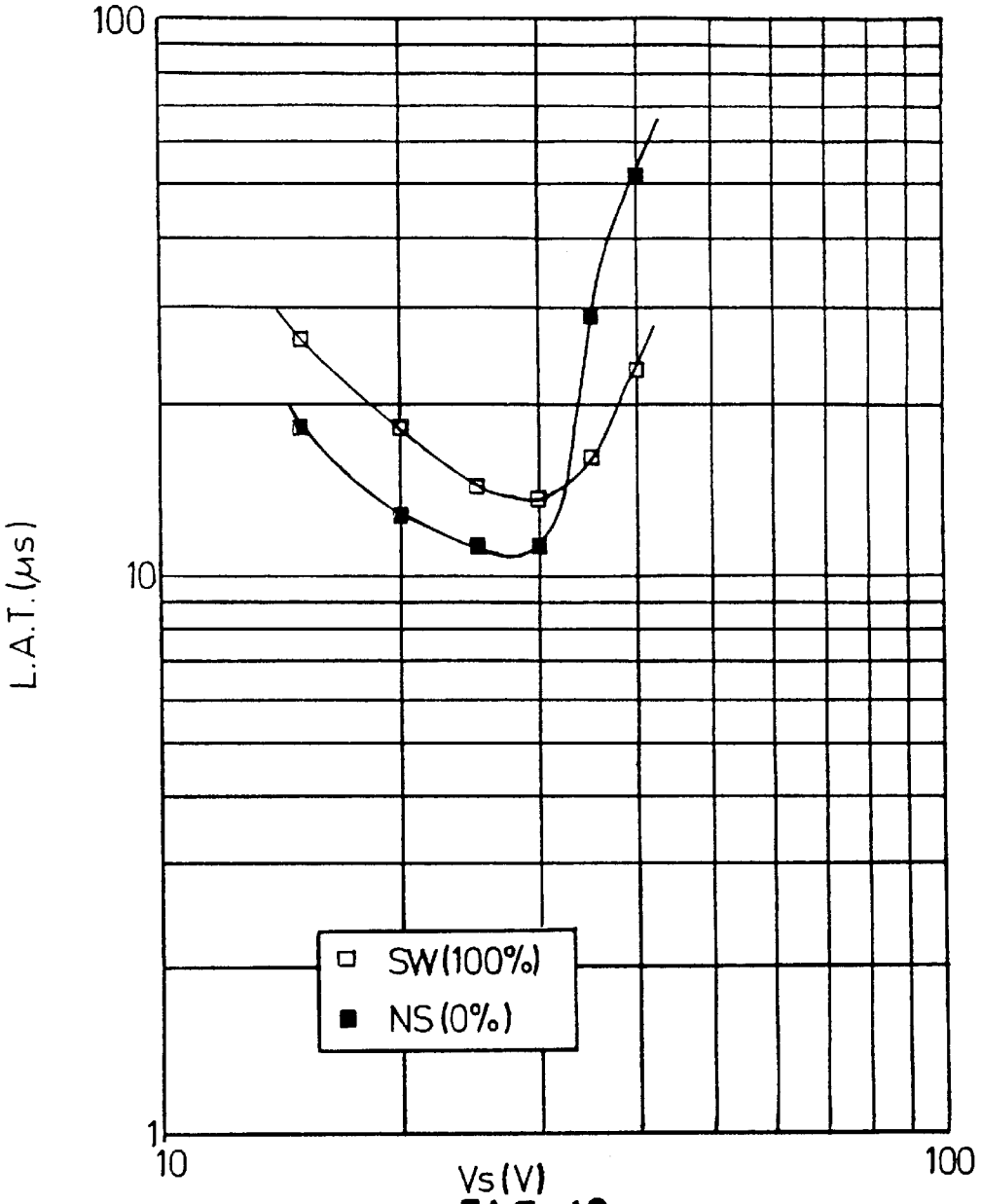
FIG. 10 shows a τV switching characteristic for a ferroelectric liquid crystal array device driven in accordance with the present invention.

FIG. 10 shows the operating region of one of the driving schemes belonging to our invention. FLC Cell-B with the thickness of 1.8 $\mu$m and the material of FLC-1 developed by us was used. Data voltage types shown in FIG. 7 with an amplitude of 5.77 $V_{op}$ were used with a three slot strobe pulse. This strobe pulse comprised a first slot of zero volt followed by two slots of $V_S$ such that the application of the strobe to adjacent rows overlapped (see UK Patent number 2,262,831). It is clear that this new type of data waveform gives a satisfactory drive window.

The first curve, indicated by hollow squares in FIG. 10, represents driving conditions (combinations of l.a.t. and Vs) for switching a whole pixel from black to white. A black pixel can be completely turned white when a voltage having a waveform which satisfies a driving condition found in the area above the first curve is applied.

The second curve, indicated by solid squares in FIG. 10, represents driving conditions for keeping a whole black pixel black (non-switching). A black pixel can remain black when a voltage having a waveform which satisfies a driving condition found in the area below the second curve is applied.

When a liquid crystal cell is driven to act as a display, these two kinds of driving conditions need to be combined. In this case, a driving condition is chosen from the common portion of the area above the first curve and the area below the second curve. The common portion is called an "operating region." It is clear that this new type of data waveform gives a satisfactory operating region.

The material FLC-1 has the following characteristics:

a tilted chiral smectic phase, e.g. a smectic C phase Sc* a minimum in its switching-time-to-voltage characteristic a spontaneous polarization less than 20 nC/cm$^2$ (typically less than 10 nC/cm$^2$)

a positive dielectric biaxiality

The Ferroelectric Liquid Crystal SCE 8 as discussed previously is also a suitable material.

Figure 11:
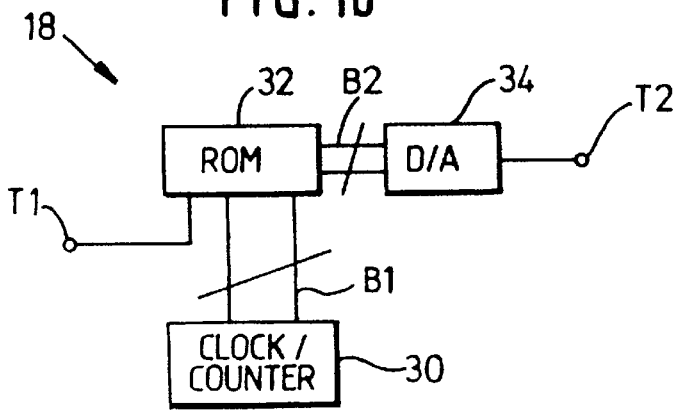
FIG. 11 shows a block schematic diagram of part of a column driven suitable for implementing the present invention.

FIG. 11 shows a portion of an embodiment of column driver 18 for providing data signals in accordance with the invention. A clock and counter arrangement 30 provides an addressing signal to a Read Only Memory (ROM) 32 via a bus B1. The ROM 32 is also provided with a signal from a terminal T1 which is connected to the controller 28 (FIG. 1). The ROM 32 provides a data signal via a bus B2 to a Digital to Analogue Converter (D/A) 34 which provides a signal to one of the column electrodes 16 (FIG. 1). The input at the terminal T1 determines whether the signal supplied by the ROM 32 under control of the clock/counter 30 comprises:

0, 0, −1, −1, −1, −1, −1, −1, −1, −1, 0, 0, +1, +1, +1, +1, +1, +1, +1, +1 or 0, 0, +1, +1, +1, +1, +1, +1, +1, +1, 0, 0, −1, −1, −1, −1, −1, −1, −1, −1 to cause the D/A 34 to provide either of the desired data signals. The rate at which the ROM 32 is clocked by the clock/counter 30 could be increased to provide greater resolution in the data waveforms. A read-only-memory having more than three states per data location could also be used. Alternative arrangements for providing the data signals in accordance with the present invention will be readily apparent to the skilled person.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A liquid crystal array device comprising:

a liquid crystal material contained between two substrates, a first and a second plurality of electrodes defining a plurality of pixels, and driving circuitry for applying a first signal in succession to the first plurality of electrodes and for applying a plurality of second signals to each of the second plurality of electrodes, each second signal comprising one of at least a first waveform and a second waveform, the first waveform and the second waveform each comprising first and second signal levels having opposite polarities, wherein the first waveform and the second waveform further comprise at least one portion at a third signal level different from the first and second signal levels and disposed in time sequence therebetween to provide a limited difference in heating effect upon the array between a signal comprising a plurality of first waveforms and a signal comprising an alternating succession of first and second waveforms, and a duration of a pulse included in the first signal is longer than a duration of an excursion of the second signals to the first and second signal levels.

2. A liquid crystal array device as claimed in claim 1, wherein the third signal level of the first and second waveforms is between the first and second signal levels.

3. A liquid crystal array device as claimed in claim 2, wherein the first and second waveforms are bi-polar waveforms and the third signal level is zero volt.

4. A liquid crystal array device as claimed in claim 3 wherein the first signal level and the second signal level are equal in magnitude.

5. A liquid crystal array device as claimed in claim 1 wherein the portion of the respective first and second waveforms at the third signal level comprises at most one quarter of the duration of the respective first and second waveforms.

6. A liquid crystal array device as claimed in claim 1 wherein the first and second waveforms comprise a further portion at the third signal level.

7. A liquid crystal array device as claimed in claim 6, wherein the first waveform comprises a portion of first signal level followed by a portion of third signal level followed by a portion of second signal level followed by a portion of third signal level and the second waveform comprises a portion of second signal level followed by a portion of third signal level followed by a portion of first signal level followed by a portion of third signal level.

8. A liquid crystal array device as claimed in claim 1, wherein the RMS voltage of a signal comprising one of the first and second waveforms followed by the same one of the first and second waveforms and the RMS voltage of a signal comprising the first waveform followed by the second waveform are substantially equal.

9. A liquid crystal array device as claimed in claim 7, wherein the RMS voltage of a signal comprising one of the first and second waveforms followed by the same one of the first and second waveforms and the RMS voltage of a signal comprising the first waveform followed by the second waveform are substantially equal.

10. A liquid crystal array device as claimed in claim 1, wherein the liquid crystal material is ferroelectric.

11. A driving arrangement for a liquid crystal array device, which device comprises a liquid crystal material contained between two substrates and a first and a second plurality of electrodes defining a plurality of pixels, the driving arrangement comprising:

means for applying a first signal in succession to the first plurality of electrodes and means for applying a plurality of second signals to each of the second plurality of electrodes which second signals each comprise one of at least a first and a second waveform, the first and second waveforms each comprising first and second signal levels having opposite polarities, wherein each of the first and second waveforms further comprise at least one portion at a third signal level different from the first and second signal levels and disposed in time sequence therebetween for providing a limited difference in heating effect when a signal comprising a plurality of first waveforms is applied to the liquid crystal array device and when a signal comprising alternating first and second waveforms is applied to the device, and a duration of a pulse included in the first signal is longer than a duration of an excursion of the second signals to the first and second signal levels.

12. A driving arrangement as claimed in claim 11, wherein the third signal level of the first and second waveforms is between the first and second signal levels.

13. A driving arrangement as claimed in claim 12, wherein the first and second waveforms are bi-polar waveforms and the third signal level is zero volt.

14. A driving arrangement as claimed in claim 11, wherein the portion of the respective first and second waveforms at the third signal level comprises at most one quarter of the duration of the respective first and second waveforms.

15. A driving arrangement as claimed in claim 11, wherein the first and second waveforms comprise a further portion at the third signal level.

16. A method of driving a liquid crystal array device, which device comprises a liquid crystal material contained between two substrates and a first and a second plurality of electrodes defining a plurality of cells, the method comprising applying a first signal in succession to the first plurality of electrodes and applying a plurality of second signals to each of the second plurality of electrodes which second signals each comprise one of at least a first and a second waveform, the first and second waveforms each comprising first and second signal levels having opposite polarities, wherein each of the first and second waveforms further comprise at least one portion at a third signal level different from the first and second levels and disposed in time sequence therebetween for providing a limited difference in heating effect upon the array when a signal comprising a plurality of first waveforms is applied to the array and when a signal comprising alternating first and second waveforms is applied to the array, and a duration of a pulse included in the first signal is longer than a duration of an excursion of the second signals to the first and second signal levels.

17. A method of driving a liquid crystal array device as claimed in claim 16, wherein the third signal level of the first and second waveforms is between the first and second signal levels.

18. A method of driving a liquid crystal array device as claimed in claim 17, wherein the first and second waveforms are bi-polar waveforms and the third signal level is zero volt.

19. A method of driving a liquid crystal array device as claimed in claim 16, wherein the portion of the respective first and second waveforms at the third signal level comprises at most one quarter of the duration of the respective first and second waveforms.

20. A method of driving a liquid crystal array device as claimed in claim 16, wherein the first and second waveforms comprise a further portion at the third signal level.

* * * * *